US006219892B1

(12) United States Patent
Johnsen

(10) Patent No.: US 6,219,892 B1
(45) Date of Patent: Apr. 24, 2001

(54) DISPLAY HANGER FOR SHEET ITEMS OF FABRIC ART

(76) Inventor: Gwyneth K. Johnsen, 42 W392 Foxfield Dr. West, St. Charles, IL (US) 60175

( * ) Notice: Subject to any disclaimer, the term of this patent is extended or adjusted under 35 U.S.C. 154(b) by 0 days.

(21) Appl. No.: 09/323,631

(22) Filed: Jun. 1, 1999

(51) Int. Cl.[7] ..... A47H 5/00; A47H 13/00

(52) U.S. Cl. ..... 24/716; 24/499; 24/706.1; 16/87.2; 160/330

(58) Field of Search ..... 24/499, 716, 706.1, 24/706; 16/87.2, 93 D; 160/330

(56) References Cited

U.S. PATENT DOCUMENTS

| | | | | |
|---|---|---|---|---|
| D. 320,521 | | 10/1991 | Baur . | |
| D. 368,197 | | 3/1996 | Fulayter et al. . | |
| 784,818 | * | 3/1905 | Evans | 160/330 |
| 2,840,155 | * | 6/1958 | Stern | 16/87.2 |
| 3,905,414 | * | 9/1975 | Guebert et al. | 160/330 |
| 4,230,171 | * | 10/1980 | Baker, Sr. | 160/84 R |
| 4,375,134 | | 3/1983 | Sheetz . | |
| 4,736,535 | | 4/1988 | Rucker . | |
| 5,191,922 | * | 3/1993 | Wade | 160/330 |
| 5,318,174 | | 6/1994 | Zoroufy . | |
| 5,351,739 | * | 10/1994 | Levy | 160/330 |
| 5,544,387 | * | 8/1996 | Yamamoto et al. | 16/87.2 |
| 5,592,721 | | 1/1997 | Zeller . | |

FOREIGN PATENT DOCUMENTS

| | | | | |
|---|---|---|---|---|
| 1052774 | * | 12/1966 | (GB) | 16/87.2 |

* cited by examiner

*Primary Examiner*—Victor N. Sakran
(74) *Attorney, Agent, or Firm*—John R. Hoffman

(57) ABSTRACT

A hanging assembly for displaying a sheet item of fabric art includes an elongated frame adapted for mounting on an appropriate upright support structure. An elongated flexible interface strip is adapted for attachment to the sheet item by appropriate non-invasive attaching media. A securing member secures the flexible interface strip to the frame.

14 Claims, 3 Drawing Sheets

DISPLAY HANGER FOR SHEET ITEMS OF FABRIC ART

FIELD OF THE INVENTION

This invention generally relates to hangers or hanging assemblies and, particularly, to a hanger for displaying a sheet item of fabric art such as a quilt, tapestry, embroidery, needlepoint, blanket, rug, flag, cloth banner and like items.

BACKGROUND OF THE INVENTION

Various types of hangers are known for displaying various items such as quilts, tapestry, rugs and other items, e.g., those items mentioned above. The items often are used to display such fabric art in various environments ranging from a personal home to a public museum. In a museum, for instance, the item of fabric art may be displayed on a wall and changed every month or so.

One of the problems with handling and displaying such sheet items of fabric art is the damage done to the items and which may become permanent. If an item is displayed, it typically has considerable value to an individual or institution. The item may be a new item of fabric art which can be quite delicate or, most often, the item is somewhat old or very old and fragile.

In particular, most prior art hanging assemblies for sheet items of fabric art use some form of pressure or clamping directly onto the item. Such forces cause stresses in the fabric and even can cause permanent impressions. This is particularly true if the item is old. Even newer items can be damaged when the item is a large quilt, tapestry, blanket or rug which is quite heavy. The weight, combined with the clamping forces, actually can separate the fabric weave and cause considerable damage to valuable works of art.

The present invention is directed to solving these problems by providing a unique system which utilizes an interface member which can be attached to the sheet item with appropriate non-invasive attaching means. The interface member then is secured to a frame of the hanging assembly and absorbs the abusive forces therefrom. In other words, the hanging assembly of the invention isolates the sheet item of fabric art from abusive clamping or other forces. The assembly also is versatile, easy to use and is arranged so as not to be visible in use.

SUMMARY OF THE INVENTION

An object, therefore, of the invention is to provide a new and improved hanger for displaying a sheet item of fabric art such as a quilt, tapestry, embroidery, needlepoint, blanket, rug, flag, cloth banner and other similar items.

In the exemplary embodiment of the invention, the hanger is provided as an assembly which includes an elongated frame adapted for mounting on an appropriate support structure, such as a wall. An elongated flexible interface strip is adapted for attachment to the sheet item by appropriate non-invasive attaching means, such as pins or basting thread. Securing means are provided for securing the flexible interface strip to the frame.

As disclosed herein, the elongated frame comprises a pair of elongated clamp bars for clamping the securing means therebetween. Generally, spring means are provided for biasing the clamp bars into mutually clamping condition. Specifically, at least one hinge connects the clamp bars for relative movement between an open loading position and a closed clamping position. The hinge is spring loaded for biasing the clamp bars to their closed clamping position. At least one of the clamp bars includes a channel running lengthwise thereof for receiving the securing means which may be in the form of a rod.

The flexible interface strip comprises a cloth-like strip for receiving the non-invasive attaching means such as the pins or basting thread. The interface strip includes a passage running lengthwise thereof for receiving the securing rod.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
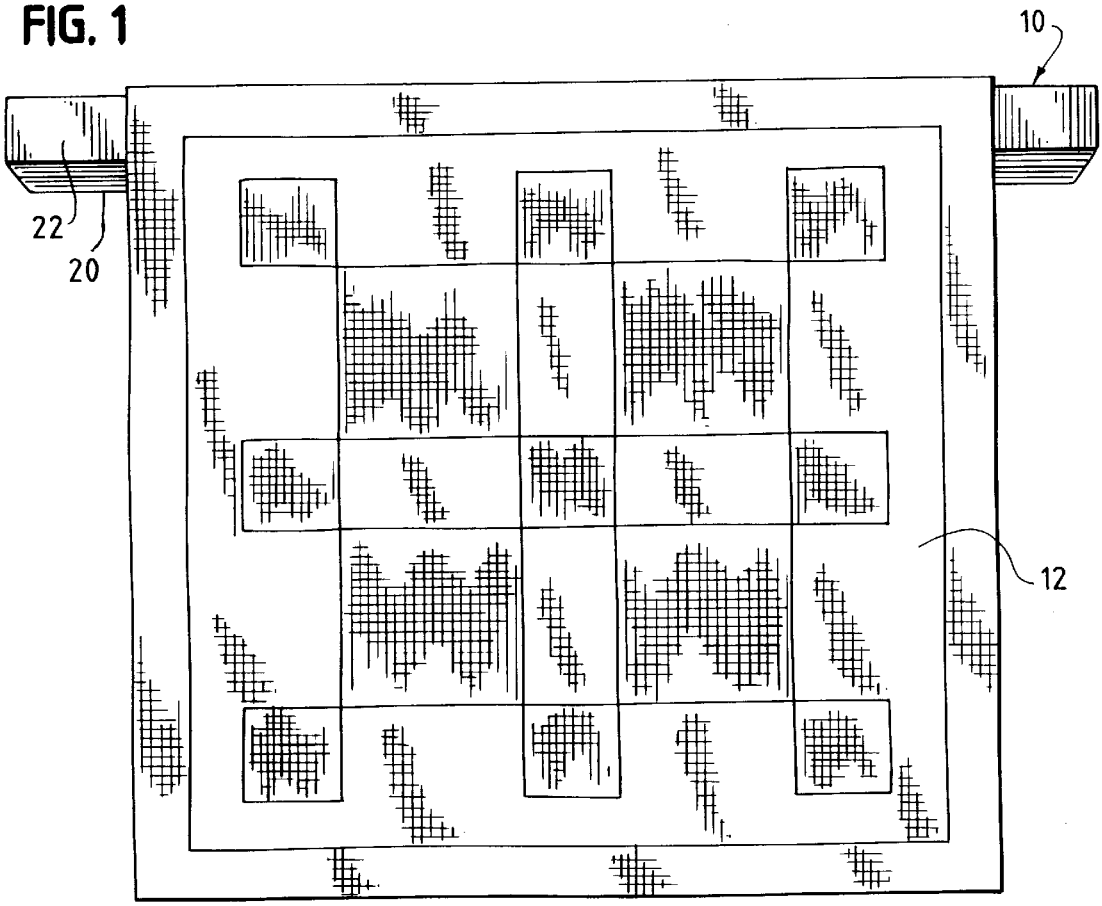
FIG. 1 a perspective view of the hanging assembly of the invention, shown hanging a quilt thereon.

Referring to the drawings in greater detail, and first to FIG. 1, the invention is embodied in a hanging assembly, generally designated 10, for displaying a sheet item 12 of fabric art. The item shown herein is a quilt. However, it should be understood that the hanging assembly of the invention is equally applicable for displaying other sheet items such as a tapestry, embroidery, needlepoint, blanket, rug, flag, cloth banner and other similar items.

Figure 2:
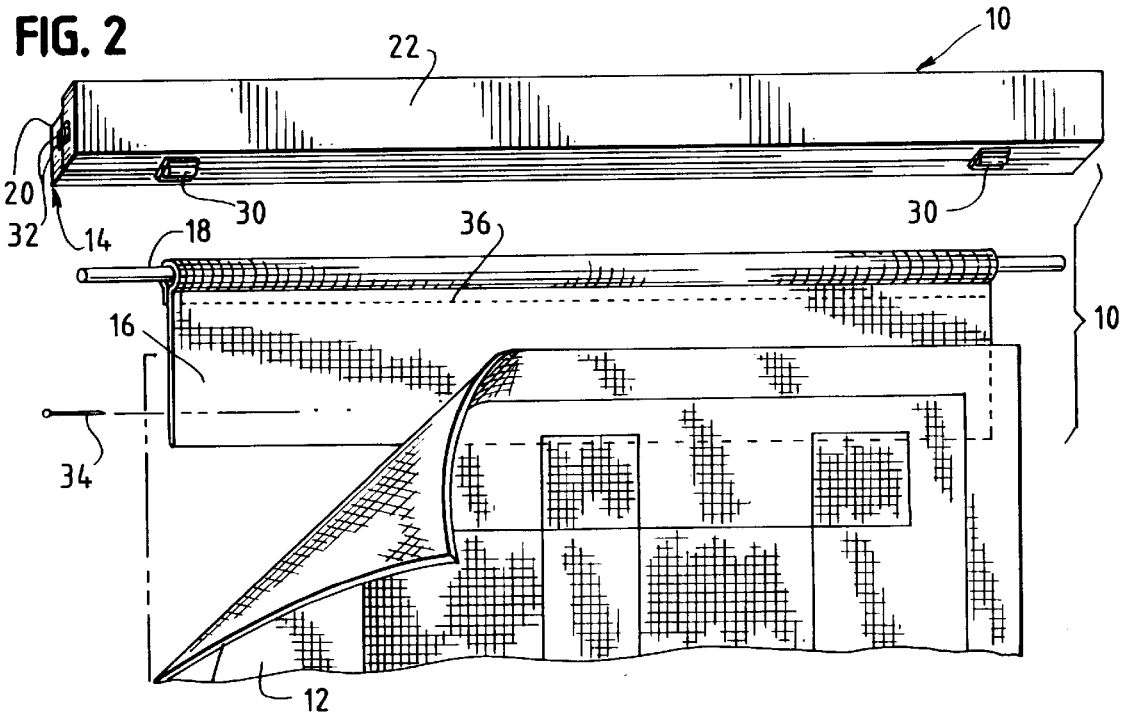
FIG. 2 is an exploded perspective view of the components of the hanging assembly of FIG. 1, in conjunction with the quilt.

Referring to FIG. 2, hanging assembly 10 includes an elongated frame, generally designated 14, adapted for mounting on an appropriate upright support structure such as a wall; an elongated flexible interface strip 16 adapted for attachment to the sheet item or quilt 12 by appropriate non-invasive attaching means; and securing means in the form of a rod 18 for securing flexible interface strip 16 to frame 14.

Figure 3:
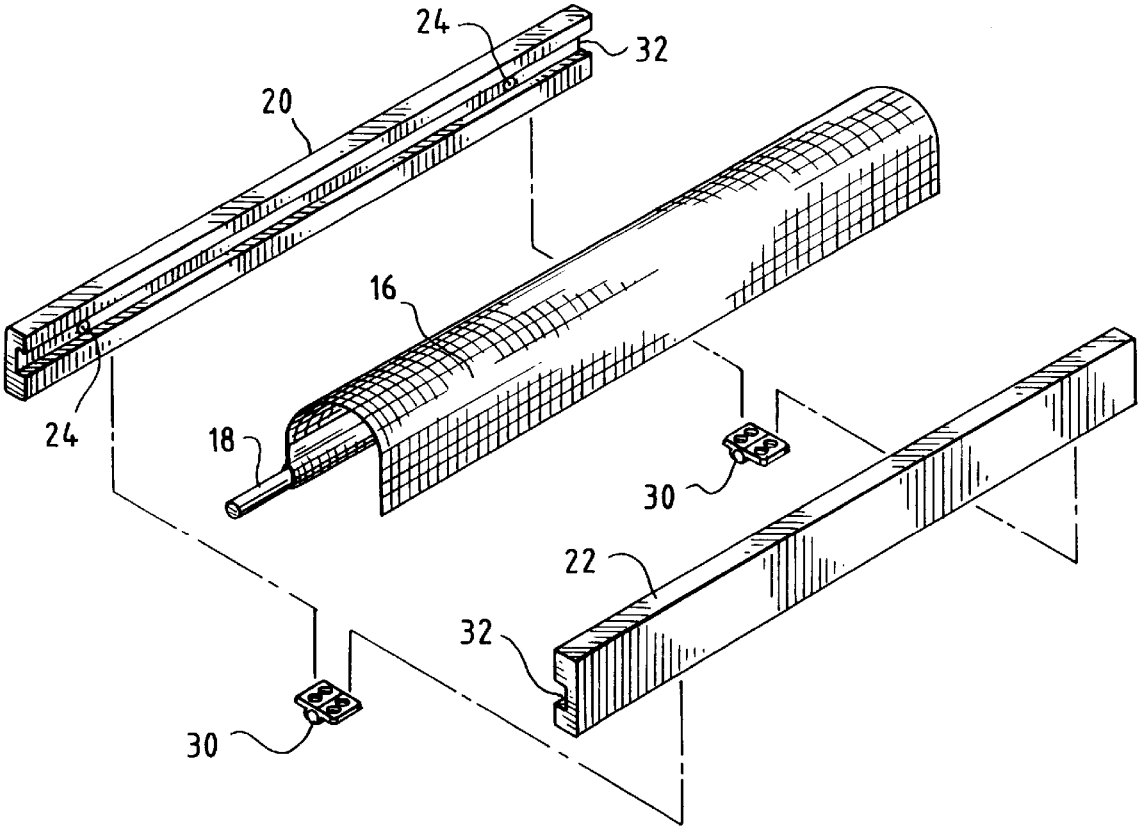
FIG. 3 is a further exploded perspective view of the components of the hanging assembly, isolated from the quilt.
Figure 4:
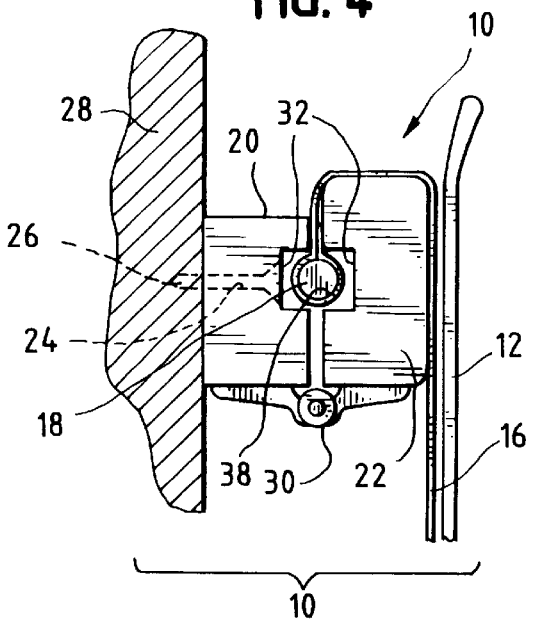
FIG. 4 is an end elevational view of the hanging assembly and quilt as viewed from one end of the assembly in FIG. 1.

Referring to FIGS. 3 and 4 in conjunction with FIG. 2, frame 14 comprises a frame assembly which includes a pair of elongated clamp bars 20 and 22. Clamp bar 20 has a plurality of holes 24 through which appropriate fastening means such as screws 26 (FIG. 4) can be used to attach rear clamp bar 20 to an appropriate support structure such as a wall 28 (FIG. 4). Front clamp bar 22 is attached to rear clamp bar 20 by a pair of hinges 30 attached by appropriate screws to the bottom surfaces of the clamp bars which may be fabricated of such materials as wood, plastic or the like. The hinges are spring loaded for biasing the clamp bars to a closed clamping position shown in FIGS. 2 and 4. Finally, the inside surface of each clamp bar 20 and 22 is provided with an open channel 32 extending lengthwise thereof. As seen in FIG. 4, when the clamp bars are in the closed clamping position, channels 32 are aligned or face each other to define a closed elongated cavity.

Flexible interface strip 16 may be provided as a cloth-like strip for receiving such non-invasive attaching means as pins 34 (FIG. 2) to attach quilt 12 to the interface strip. Another excellent non-invasive attaching means is basting thread which can be used to attach the sheet item or quilt to the interface strip lengthwise of the strip, using a "running" stitch or basting stitch. If the sheet item of fabric art is heavy, such as a quilt, tapestry, rug or the like, two or more lines or rows of running stitches can be used to avoid concentrated stresses in the sheet item. The top edge of interface strip 16 is folded over and stitched, as at 36 in FIG. 2, to form a passage 38 running lengthwise thereof for receiving securing rod 18. The rod may be a simple dowel-type rod.

Figure 5:
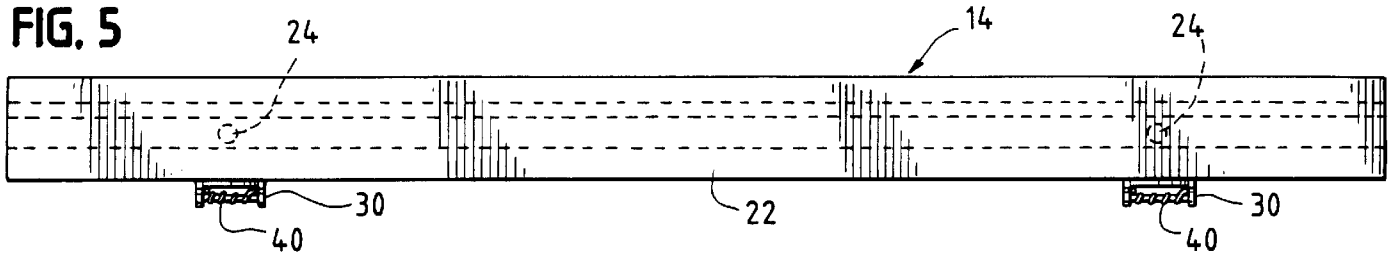
FIG. 5 is a front elevational view of the elongated frame in closed position.
Figure 6:
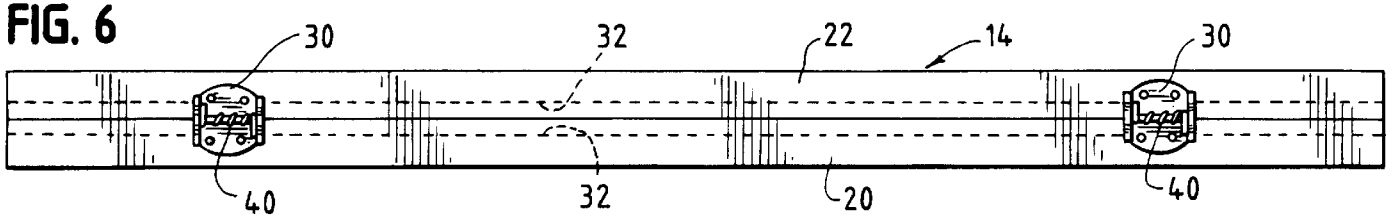
FIG. 6 is a bottom plan view of the frame in closed position.
Figure 7:
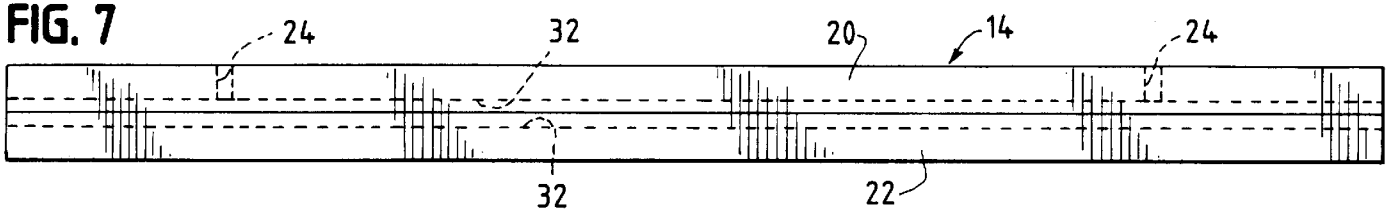
FIG. 7 is a top plan view of the frame in closed position.
Figure 8:
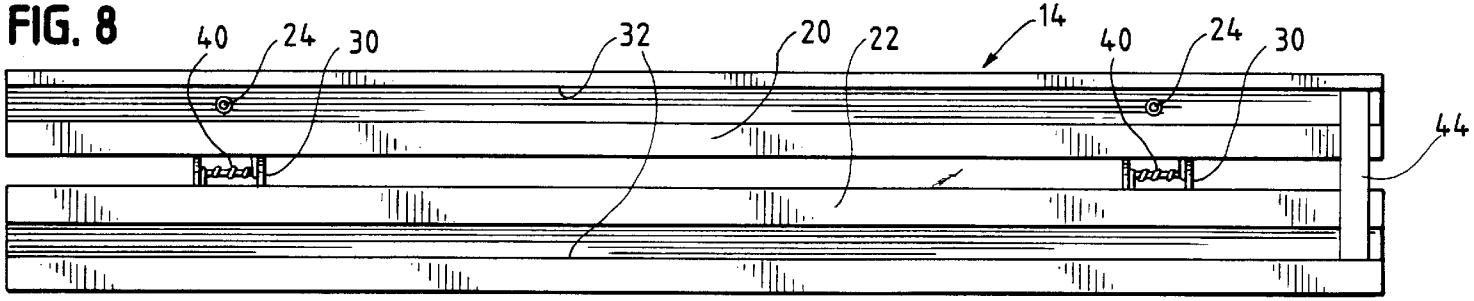
FIG. 8 is a front elevational view similar to that of FIG. 5, but with the frame in open position.

FIGS. 5–7 show elongated frame assembly 14 with elongated clamp bars 20 and 22 biased to their closed clamping position by spring loaded hinges 30. FIGS. 5 and 6 show the hinges to include coiled springs 40 to spring load the hinges. FIG. 8 shows clamp bars 20 and 22 of frame assembly 14 in their open loading position exposing channels 32 formed in the inside surfaces of the clamp bars.

The use of hanging assembly 10 now will be described, in conjunction with hanging quilt 12 for display purposes. The quilt first is placed on a horizontal support surface, such as a bed, large table, countertop or the like where it is not subject to any stresses whatsoever. Flexible interface strip 16 then is attached to the quilt along what would be its top edge by appropriate non-invasive attaching means. As stated above, such non-invasive attaching means could be one or more rows of pins 34 or one or more lines of running stitches of basting thread. Again, this process does not expose the quilt to any abusive stresses whatsoever. Securing rod 18 then can be inserted through passage 38 formed in the flexible interface strip. Of course, the rod could have been inserted prior to attaching the strip to the quilt. With rear clamp bar 20 fixed to an appropriate upright support structure such as wall 20, front clamp bar 22 is opened as shown in FIG. 8. The quilt and attached interface strip 16 can be gently elevated and placed on top of the assembly. The front clamp bar is gently pulled down to expose channels 32 and securing rod 18 is placed in position to be captured within channels 32 of the clamp bars. This is most easily accomplished by placing the securing rod in channel 32 of front clamp bar 22 as shown in the open position of FIG. 8, and simply allowing the spring biasing of hinges 30 to gently close the front clamp bar against rear clamp bar 20 to capture securing rod 18 and the surrounding interface strip as shown in FIG. 4. As stated above, in the closed clamping position of the clamp bars, channels 32 combine to form a closed elongated cavity for capturing securing rod 18 and the surrounding portions of the flexible interface strip. The strip simply drapes over the top and down the front face of front clamp bar 22 as seen in FIG. 4. A stop piece 44 (FIG. 8) can be used to hold the clamp bars open while securing the assembly to a wall by screws 26.

After the quilt is hung as described above, it can be seen in FIG. 4 that hanging assembly 10 is completely hidden behind the upper edge of the quilt. In addition, although FIGS. 1 and 2 show the hanging assembly to be longer than the width of the quilt, the hanging assembly can be readily made in a variety of lengths so that the entire assembly is hidden behind the upper edge of the quilt. Different lengths of hanging assemblies can be fabricated for different sizes of sheet items of fabric art. Although interface strip 16 can be appropriately provided of cloth-like material, a plastic strip also could be used. Although the invention is shown herein hanging quilt 12 on a wall 28, other sheet items of fabric art can be hung on a variety of other appropriate upright support structures, even including a bed frame for hanging a bed canopy. It can be understood that interface strip 16 isolates the hanging stresses from quilt 12. In other words, the quilt is gently attached to the interface strip by the non-invasive pins or thread, and the clamping hanging stresses are absorbed by securing rod 18 at the top of the interface strip. The quilt or other work of art, in essence, is not altered in any way and certainly is not disfigured by any clamping forces.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A hanging assembly for displaying a sheet item of fabric art including a quilt, tapestry, embroidery, needlepoint, blanket, rug, flag and cloth banner, comprising:

an elongated frame adapted for mounting on an appropriate upright support structure, the frame including a pair of elongated relatively movable clamp bars;

an elongated flexible interface strip adapted for attachment to the sheet item by appropriate non-invasive attaching means; and securing means for being clamped by said clamp bars and, thereby, securing the flexible interface strip to the frame.

2. The hanging assembly of claim 1, including spring means for biasing said clamp bars into mutually clamping condition.

3. The hanging assembly of claim 1, including hinge means connecting the clamp bars for relative movement between an open loading position and a closed clamping position.

4. The hanging assembly of claim 3 wherein said hinge means comprises at least one spring loaded hinge for biasing the clamp bars to their closed clamping position.

5. The hanging assembly of claim 1 wherein at least one of said elongated clamp bars includes a channel running lengthwise thereof for receiving said securing means in the form of a rod.

6. The hanging assembly of claim 1 wherein said flexible interface strip comprises a cloth-like strip for receiving such non-invasive attaching means as pins and thread to attach the sheet item to the interface strip.

7. The hanging assembly of claim 1 wherein said flexible interface strip includes a passage running lengthwise thereof for receiving said securing means in the form of a rod.

8. The hanging assembly of claim 1 wherein said elongated frame includes a channel running lengthwise thereof for receiving said securing means in the form of a rod.

9. A hanging assembly for displaying a sheet item of fabric art including a quilt, tapestry, embroidery, needlepoint, blanket, rug, flag and cloth banner, comprising:

an elongated frame adapted for mounting on an appropriate upright support structure, said frame including a pair of elongated clamp bars;

an elongated flexible cloth-like interface strip for receiving such non-invasive attaching means as pins and thread to attach the sheet item to the interface strip; and securing means for securing the flexible interface strip between the clamp bars of the elongated frame.

10. The hanging assembly of claim 9, including spring means for biasing said clamp bars into mutually clamping condition.

11. The hanging assembly of claim 9, including hinge means connecting the clamp bars for relative movement between an open loading position and a closed clamping position.

12. The hanging assembly of claim 11 wherein said hinge means comprises at least one spring loaded hinge for biasing the clamp bars to their closed clamping position.

13. The hanging assembly of claim 9 wherein at least one of said elongated clamp bars includes a channel running lengthwise thereof for receiving said securing means in the form of a rod.

14. The hanging assembly of claim 9, wherein said flexible interface strip includes a passage running lengthwise thereof for receiving said securing means in the form of a rod.

* * * * *